US009129555B2

(12) United States Patent
Lee et al.

(10) Patent No.: US 9,129,555 B2
(45) Date of Patent: Sep. 8, 2015

(54) LIGHT EMITTING DIODE DISPLAY DEVICE

(71) Applicant: LG DISPLAY CO., LTD., Seoul (KR)

(72) Inventors: Jae-Myon Lee, Seoul (KR); Nam-Wook Cho, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 59 days.

(21) Appl. No.: 14/109,028

(22) Filed: Dec. 17, 2013

(65) Prior Publication Data

US 2014/0176402 A1 Jun. 26, 2014

(30) Foreign Application Priority Data

Dec. 20, 2012 (KR) ..... 10-2012-0149852

(51) Int. Cl.
*G09G 3/32* (2006.01)

(52) U.S. Cl.
CPC ..... *G09G 3/32* (2013.01); *G09G 3/3233* (2013.01); *G09G 2300/0465* (2013.01); *G09G 2300/0814* (2013.01); *G09G 2300/0819* (2013.01); *G09G 2300/0842* (2013.01); *G09G 2300/0861* (2013.01)

(58) Field of Classification Search
CPC ..... G09G 3/32–3/3208; G09G 3/3225–3/325
See application file for complete search history.

(56) References Cited

U.S. PATENT DOCUMENTS

| | | | |
|---|---|---|---|
| 2005/0200617 | A1 | 9/2005 | Kwak et al. |
| 2008/0258626 | A1 | 10/2008 | Furuie et al. |
| 2010/0283776 | A1* | 11/2010 | Park et al. ..... 345/211 |

FOREIGN PATENT DOCUMENTS

| | | | |
|---|---|---|---|
| CN | 1801298 | A | 7/2006 |
| EP | 1679687 | A2 | 7/2006 |
| JP | 2003-122306 | | 4/2003 |
| JP | 2006-119639 | | 5/2006 |
| JP | 2006-189552 | | 7/2006 |
| JP | 2006-189756 | | 7/2006 |
| JP | 2006-195459 | | 7/2006 |
| JP | 2007-225738 | | 9/2007 |
| JP | 2007-304598 | | 11/2007 |
| JP | 2008268437 | A | 11/2008 |
| JP | 2009-063930 | | 3/2009 |
| JP | 2009-211104 | | 9/2009 |
| JP | 2009-276669 | | 11/2009 |
| JP | 2011-145622 | | 7/2011 |
| JP | 2012-113980 | | 6/2012 |

OTHER PUBLICATIONS

Office Action issued in Japanese Patent Application No. 2013-262502, mailed Dec. 2, 2014, 2 pages.

(Continued)

*Primary Examiner* — Liliana Cerullo
(74) *Attorney, Agent, or Firm* — Brinks Gilson & Lione

(57) ABSTRACT

An LED display device includes a first scan switching element between a data line and a first node, a first voltage transfer switching element between a first drive voltage line and the first node, a first detection switching element between second and third nodes, a first driving switching element between the first drive voltage line and the third node, a first emission control switching element between the third node and a first LED, a second scan switching element between the data line and the second node, a second voltage transfer switching element between the first drive voltage line and the second node, a second detection switching element between the first node and a fourth node, a second driving switching element, a second emission control switching element between the fourth node and a second LED, and a common capacitor between the first node and the second node.

6 Claims, 13 Drawing Sheets

(56) References Cited

OTHER PUBLICATIONS

Office Action issued in United Kingdom Patent Application No. GB1322731.9, mailed Jun. 13, 2014, 5 pages.

Chinese Search Report issued in Chinese Patent Application No. 201310706045.6, mailed Jun. 14, 2015, 4 pages.

Office Action for corresponding Chinese Application No. 201310706045.6 dated Jun. 30, 2015, 6 pages.

* cited by examiner

First Half Frame Period

Second Half Frame Period

LIGHT EMITTING DIODE DISPLAY DEVICE

This application claims the benefit of priority to Korean Patent Application No. 10-2012-0149852 filed on Dec. 20, 2012 which is hereby incorporated by reference as if fully set forth herein.

BACKGROUND

1. Field of the Disclosure

The present disclosure relates to a light emitting diode (LED) display device, and, more particularly, to an LED display device in which two pixels share one common capacitor, to reduce the area occupied by each pixel, thereby being capable of facilitating manufacture of a display panel having high resolution and high definition.

2. Discussion of the Related Art

Pixels of an LED display device each includes a driving switching element, which is a current regulating element. The current driving capability of such a driving switching element is greatly influenced by the threshold voltage of the driving switching element. For this reason, it is important to correct current driving capability deviation among driving switching elements of pixels, for an enhancement in picture quality of the display device. For such a function, a large number of switching elements and a large number of capacitors should be formed at each pixel. As a result, pixel size is inevitably increased. This causes many restrictions in manufacturing a panel having high resolution.

SUMMARY

A light emitting diode display device includes a first scan switching element connected between a data line and a first node while being controlled in accordance with a first scan signal, a first voltage transfer switching element connected between a first drive voltage line to transmit a first drive voltage and the first node while being controlled in accordance with a first voltage transfer control signal, a first detection switching element connected between a second node and a third node while being controlled in accordance with a first threshold voltage detection signal, a first driving switching element connected between the first drive voltage line and the third node while being controlled in accordance with a signal applied to the second node, a first emission control switching element connected between the third node and a first light emitting diode while being controlled in accordance with a first emission control signal, a second scan switching element connected between the data line and the second node while being controlled in accordance with a second scan signal, a second voltage transfer switching element connected between the first drive voltage line and the second node while being controlled in accordance with a second voltage transfer control signal, a second detection switching element connected between the first node and a fourth node while being controlled in accordance with a second threshold voltage detection signal, a second driving switching element connected between the first drive voltage line and the third node while being controlled in accordance with a signal applied to the second node, a second emission control switching element between the fourth node and a second light emitting diode while being controlled in accordance with a second emission control signal, and a common capacitor connected between the first node and the second node.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE EXEMPLARY EMBODIMENTS

Reference will now be made in detail to the preferred embodiments of the present invention, examples of which are illustrated in the accompanying drawings.

Figure 1:
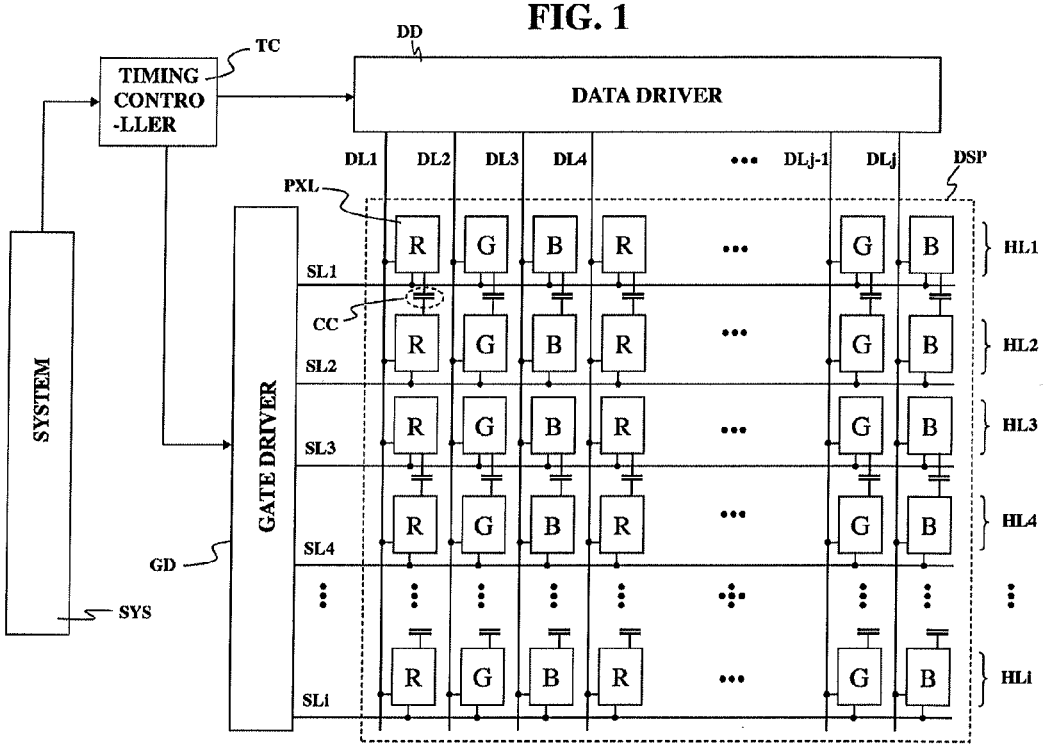
FIG. 1 is a diagram illustrating a light emitting diode (LED) display device according to an exemplary embodiment of the present invention.

FIG. 1 is a diagram illustrating a light emitting diode (LED) display device according to an exemplary embodiment of the present invention.

As illustrated in FIG. 1, the LED display device according to the illustrated embodiment of the present invention includes a display panel (DSP), a system SYS, a gate driver GD, a data driver DD, and a timing controller TC.

The display panel DSP includes a plurality of pixels PXL, i scan lines SL1 to SLi (i is a natural number greater than 1), and j data lines DL1 to DLj (j is a natural number greater than 1).

The pixels PXL are arranged in the form of a matrix array on the display panel DSP. The pixels PXL are classified into red pixels PXL to display red, green pixels PXL to display green and blue pixels PXL to display blue. Three horizontally adjacent pixels, which are one red pixel, one green pixel, and one blue pixel, constitute a unit pixel to display a unit image.

Meanwhile, although not shown in FIG. 1, the display panel DSP is further formed with a first drive voltage line, a second drive voltage line, i transfer switch control lines, i detection switch control lines, and i emission switch control lines.

That is, the first drive voltage line, second drive voltage line, first to i-th scan lines, first to i-th transfer switch control lines, first to i-th detection switch control lines, and first to i-th emission switch control lines are formed at the display panel DSP.

A first drive voltage is applied to the first drive voltage line, whereas a second drive voltage is applied to the second drive voltage line. First to i-th scan signals are applied to the first to i-th scan lines, respectively. First to i-th voltage transfer control signals are applied to the first to i-th transfer switch control lines, respectively. First to i-th threshold voltage detection signals are applied to the first to i-th detection switch control lines, respectively. The first to i-th threshold voltage detection signals are also applied to the first to i-th emission switch control lines, respectively.

The pixels arranged along a k-th horizontal line (k is one of 1 to i) (hereinafter, referred to as "k-th horizontal line pixels") are connected in common to the first drive voltage line, second drive voltage line, k-th transfer switch control line, k-th detection switch control line, k-th drive switch control line, and k-th emission switch control line.

K-th horizontal line one and k+1-th horizontal line one of the pixels connected to the same data line are connected to a common capacitor CC in common. For example, the first horizontal line's red pixel R connected to the first data line DL1 and the second horizontal line's red pixel R connected to the first data line DL1 are connected to one common capacitor CC in common.

For a first half of one frame period (namely, a first half (½) frame period), the pixels of odd-numbered horizontal lines HL1, HL3, HL5, . . . disposed above corresponding common capacitors CC use the corresponding common capacitors CC. On the other hand, a second half of one frame period (namely, a second half (½) frame period), the pixels of even-numbered horizontal lines HL2, HL4, HL6, . . . disposed below corresponding common capacitors CC use the corresponding common capacitors CC.

For a first half frame period, the pixels of the odd-numbered horizontal lines are driven in a sequential manner. Thereafter, for a second half frame period, the pixels of the even-numbered horizontal lines are driven in a sequential manner. For example, for the first half frame period, the pixels of the first horizontal line HL1, the pixels of the third horizontal line HL3, the pixels of fifth horizontal line HL5, , , , and the pixels of the i−1-th horizontal line HLi−1 are driven in a sequential manner on a per horizontal line basis. Thereafter, for the second half frame period, the pixels of the second horizontal line HL2, the pixels of the fourth horizontal line HL4, the pixels of sixth horizontal line HL6, , , , and the pixels of the i-th horizontal line HLi are driven in a sequential manner on a per horizontal line basis.

Each of the scan signal, voltage transfer control signal, threshold voltage detection signal, and emission signal supplied to the pixels of the same horizontal line has different states in the first and second half frame periods, respectively. That is, each of the k-th scan signal, k-th voltage transfer control signal, k-th threshold voltage detection signal, and k-th emission control signal supplied to the pixels of the k-th horizontal line in the first half frame period has a state different from that in the second half frame period.

In addition, the scan signals, voltage transfer control signals, threshold voltage detection signals, and emission control signals supplied to the pixels of the odd-numbered horizontal lines in a certain period have states different from corresponding ones of the scan signals, voltage transfer control signals, threshold voltage detection signals, and emission control signals supplied to the pixels of the even-numbered horizontal lines in the period, respectively. That is, the 2k−1-th scan signal, 2k−1-th voltage transfer control signal, 2k−1-th threshold voltage detection signal, and 2k−1-th emission control signal supplied to the pixels of the 2k−1-th horizontal line in the first half frame period have waveforms different from corresponding ones of the 2k-th scan signal, 2k-th voltage transfer control signal, 2k-th threshold voltage detection signal, and 2k-th emission control signal supplied to the pixels of the 2k-th horizontal line in the first half frame period, respectively.

Meanwhile, the same name ones of i/2 scan signals, i/2 voltage transfer control signals, i/2 threshold voltage detection signals, and i/2 emission control signals supplied to the odd-numbered horizontal lines in the first half frame period are temporally different in terms of output timing while having the same waveform. For example, the first scan signal supplied to the first horizontal line HL1 and the third scan signal supplied to the third horizontal line HL3 in the first half frame period have the same waveform. Of course, the third scan signal is output after being delayed for a predetermined time, as compared to the first scan signal. When the first scan signal is a reference, a scan signal assigned a higher number is output after being delayed for a longer time from the first scan signal. That is, the fifth scan signal is output after being further delayed than the third scan signal.

Similarly, the same name ones of i/2 scan signals, i/2 voltage transfer control signals, i/2 threshold voltage detection signals, and i/2 emission control signals supplied to the odd-numbered horizontal lines in the second half frame period are temporally different in terms of output timing while having the same waveform.

In addition, the same name ones of i/2 scan signals, i/2 voltage transfer control signals, i/2 threshold voltage detection signals, and i/2 emission control signals supplied to the even-numbered horizontal lines in the first half frame period are temporally different in terms of output timing while having the same waveform.

Similarly, the same name ones of i/2 scan signals, i/2 voltage transfer control signals, i/2 threshold voltage detection signals, and i/2 emission control signals supplied to the even-numbered horizontal lines in the second half frame period are temporally different in terms of output timing while having the same waveform.

The system SYS outputs a vertical synchronization signal, a horizontal synchronization signal, a clock signal, and image data via an interface circuit, using a low voltage differential signaling (LVDS) transmitter. The vertical and horizontal synchronization signals and clock signal output from the system SYS are supplied to the timing controller TC. Image data sequentially output from the system SYS is supplied to the timing controller TC.

The timing controller TC generates data control signals and gate control signals, using the horizontal and vertical synchronization signals and clock signal input to the timing controller TC. The timing controller TC supplies the generated data control signals and gate control signals to associated ones of the data driver DD and gate driver GD, respectively.

The data driver DD samples image data in accordance with the data control signals from the timing controller TC, latches the sampled image data for one horizontal line in every horizontal time 1H, 2H, . . . , and supplies the latched image data to the data lines DL1 to DLj. That is, the data driver DD converts the image data from the timing controller TC into an analog data signal, using a gamma voltage input from a power supply (not shown), and supplies the analog data signal to the data lines DL1 to DLj. The data driver DD also outputs a reference voltage, to supply the reference voltage to the data lines DL1 to DLj. The reference voltage may be 0[V]. Meanwhile, the data signal is a voltage obtained by adding the first drive voltage to a data voltage.

The gate driver GD generates the above-described first to i-th scan signals, first to i-th voltage transfer control signals, first to i-th threshold voltage detection signals, and first to i-th emission control signals in accordance with the gate control signals from the timing controller TC, and outputs the generated signals to associated ones of the pixels. The first to i-th scan signals, first to i-th voltage transfer control signals, first to i-th threshold voltage detection signals, and first to i-th emission control signals may have a voltage of −10[V] in an active state (low-level voltage) while having a voltage of 14[V] in an inactive state (high-level voltage).

Meanwhile, the first drive voltage and second drive voltage may be generated from the power supply. In this case, the first drive voltage may be a constant voltage of about 10[V] to 12[V], and the second drive voltage may be a constant voltage of 0[V].

Figure 2:
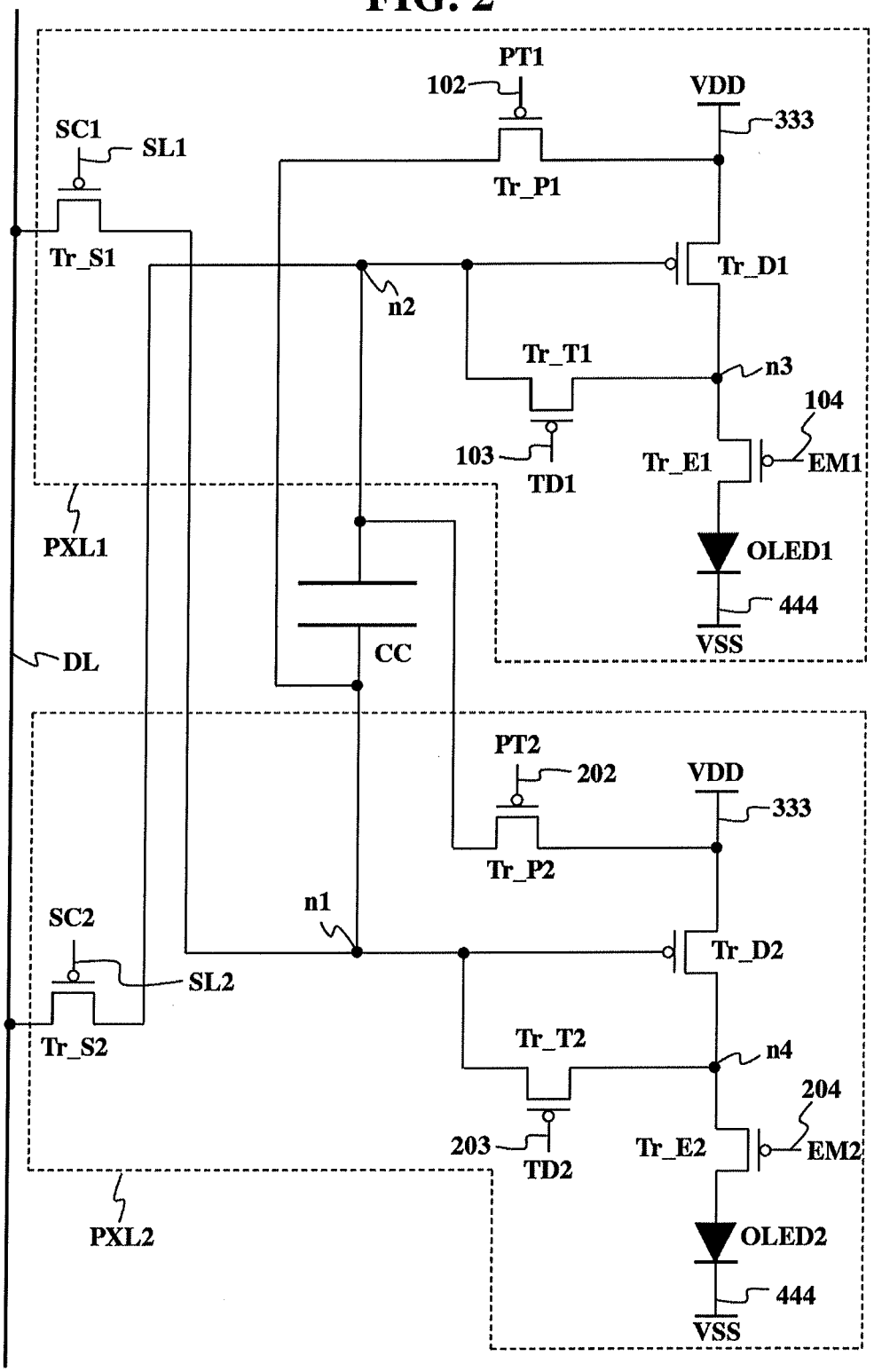
FIG. 2 is a circuit diagram illustrating a circuit configuration of the pixels according to an exemplary embodiment of the present invention.

FIG. 2 is a circuit diagram illustrating a circuit configuration of the pixels according to an exemplary embodiment of the present invention. In detail, FIG. 2 illustrates a circuit configuration of any two pixels sharing one common capacitor CC in the case of FIG. 1.

As illustrated in FIG. 2, a first one of the two pixels, namely, the first pixel PXL1, includes a first scan switching element Tr_S1, a first voltage transfer switching element Tr_P1, a first detection switching element Tr_T1, a first driving switching element Tr_D1, a first emission control switching element Tr_E1, and a first LED OLED1. A second one of the two pixels, namely, the second pixel PXL2, includes a second scan switching element Tr_S2, a second voltage transfer switching element Tr_P2, a second detection switching element Tr_T2, a second driving switching element Tr_D2, a second emission control switching element Tr_E2, and a second LED OLED2. The first pixel PXL1 and second pixel PXL2 are connected to one common capacitor CC in common.

The first scan switching element Tr_S1 is controlled in accordance with a first scan signal SC1 from the first scan line SL1. The first scan switching element Tr_S1 is connected between one data line DL and a first node n1. The first scan switching element Tr_S1 is turned on or off in accordance with the first scan signal SC1. In the ON state, the first scan switching element Tr_S1 supplies a signal applied to the data line DL to the first node n1. In this case, a reference voltage or data signal may be applied to the data line DL.

The first voltage transfer switching element Tr_P1 is controlled in accordance with a first voltage transfer control signal PT1 from a first voltage switch control line 102. The first voltage transfer switching element Tr_P1 is connected between a first drive voltage line 333 to supply a first drive voltage VDD and the first node n1. The first voltage transfer switching element Tr_P1 is turned on or off in accordance with the first voltage transfer control signal PT1. In the ON state, the first voltage transfer switching element Tr_P1 supplies the first drive voltage VDD to the first node n1.

The first detection switching element Tr_T1 is controlled in accordance with a first threshold voltage detection signal TD1 from a first detection switch control line 103. The first detection switching element Tr_T1 is connected between a second node n2 and a third node n3. The first detection switching element Tr_T1 is turned on or off in accordance with a first threshold voltage detection signal TD1. In the ON state, the first detection switching element Tr_T1 connects the second node n2 with third node n3, thereby connecting the gate with drain of the first driving switching element Tr_D1. That is, the first detection switching element Tr_T1 causes the first driving switching element Tr_D1 to have a circuit configuration in the form of a diode.

The first driving switching element Tr_D1 is controlled in accordance with a signal applied to the second node n2. The first driving switching element Tr_D1 is connected between a first drive voltage line 333 and the third node n3. The first driving switching element Tr_D1 controls an amount (density) of drive current flowing from the first drive voltage line 333 to a second drive voltage line 444 in accordance with a magnitude of the signal applied to the second node n2.

The first emission control switching element Tr_E1 is controlled in accordance with a first emission control signal EM1 from a first emission switch control line 104. The first emission control switching element Tr_E1 is connected between the third node n3 and the first LED OLED1. The first emission control switching element Tr_E1 is turned on or off in accordance with the first emission control signal EM1. In the ON state, the first emission control switching element Tr_E1 electrically connects the third node n3 with the anode of the first LED OLED1. That is, the first emission control switching element Tr_E1 transfers, to the first LED OLED1, drive current controlled by the first driving switching element Tr_D1.

The anode of the first LED OLED1 is connected to the first emission control switching element Tr_E1. The cathode of the first LED OLED1 is connected to the second drive voltage line 444 to transmit a second drive voltage VSS.

The second scan switching element Tr_S2 is controlled in accordance with a second scan signal SC2 from the second scan line SL2. The second scan switching element Tr_S2 is connected between the data line DL and the second node n2. The second scan switching element Tr_S2 is turned on or off in accordance with the second scan signal SC2. In the ON state, the second scan switching element Tr_S2 supplies the signal applied to the data line DL to the second node n2. In this case, the reference voltage or data signal may be applied to the data line DL.

The second voltage transfer switching element Tr_P2 is controlled in accordance with a second voltage transfer control signal PT2 from a second voltage switch control line 202. The second voltage transfer switching element Tr_P1 is connected between the first drive voltage line 333 to supply the first drive voltage VDD and the second node n2. The second voltage transfer switching element Tr_P2 is turned on or off in accordance with the second voltage transfer control signal PT2. In the ON state, the second voltage transfer switching element Tr_P2 supplies the first drive voltage VDD to the second node n2.

The second detection switching element Tr_T2 is controlled in accordance with a second threshold voltage detection signal TD2 from a second detection switch control line 203. The second detection switching element Tr_T2 is connected between the first node n1 and a fourth node n4. The second detection switching element Tr_T2 is turned on or off in accordance with a second threshold voltage detection signal TD2. In the ON state, the second detection switching element Tr_T2 connects the first node n1 with fourth node n4, thereby connecting the gate with drain of the second driving switching element Tr_D2. That is, the second detection switching element Tr_T2 causes the second driving switching element Tr_D2 to have a circuit configuration in the form of a diode.

The second driving switching element Tr_D2 is controlled in accordance with a signal applied to the first node n1. The second driving switching element Tr_D2 is connected between the first drive voltage line 333 and the fourth node n4. The second driving switching element Tr_D2 controls an amount (density) of drive current flowing from the first drive voltage line 333 to the second drive voltage line 444 in accordance with a magnitude of the signal applied to the first node n1.

The second emission control switching element Tr_E2 is controlled in accordance with a second emission control signal EM2 from a second emission switch control line 204. The second emission control switching element Tr_E2 is connected between the fourth node n4 and the second LED OLED2. The second emission control switching element Tr_E2 is turned on or off in accordance with the second emission control signal EM2. In the ON state, the second emission control switching element Tr_E2 electrically connects the fourth node n4 with the anode of the second LED OLED2. That is, the second emission control switching element Tr_E2 transfers, to the second LED OLED2, drive current controlled by the second driving switching element Tr_D2.

The anode of the second LED OLED2 is connected to the second emission control switching element Tr_E2. The cathode of the second LED OLED2 is connected to the second drive voltage line 444.

The common capacitor CC is connected between the second node n2 and the first node n1.

Hereinafter, operations of the pixels illustrated in FIG. 2 in the first half frame period will be described in detail with reference to FIG. 3A and FIGS. 4A to 4C.

Figure 3A:
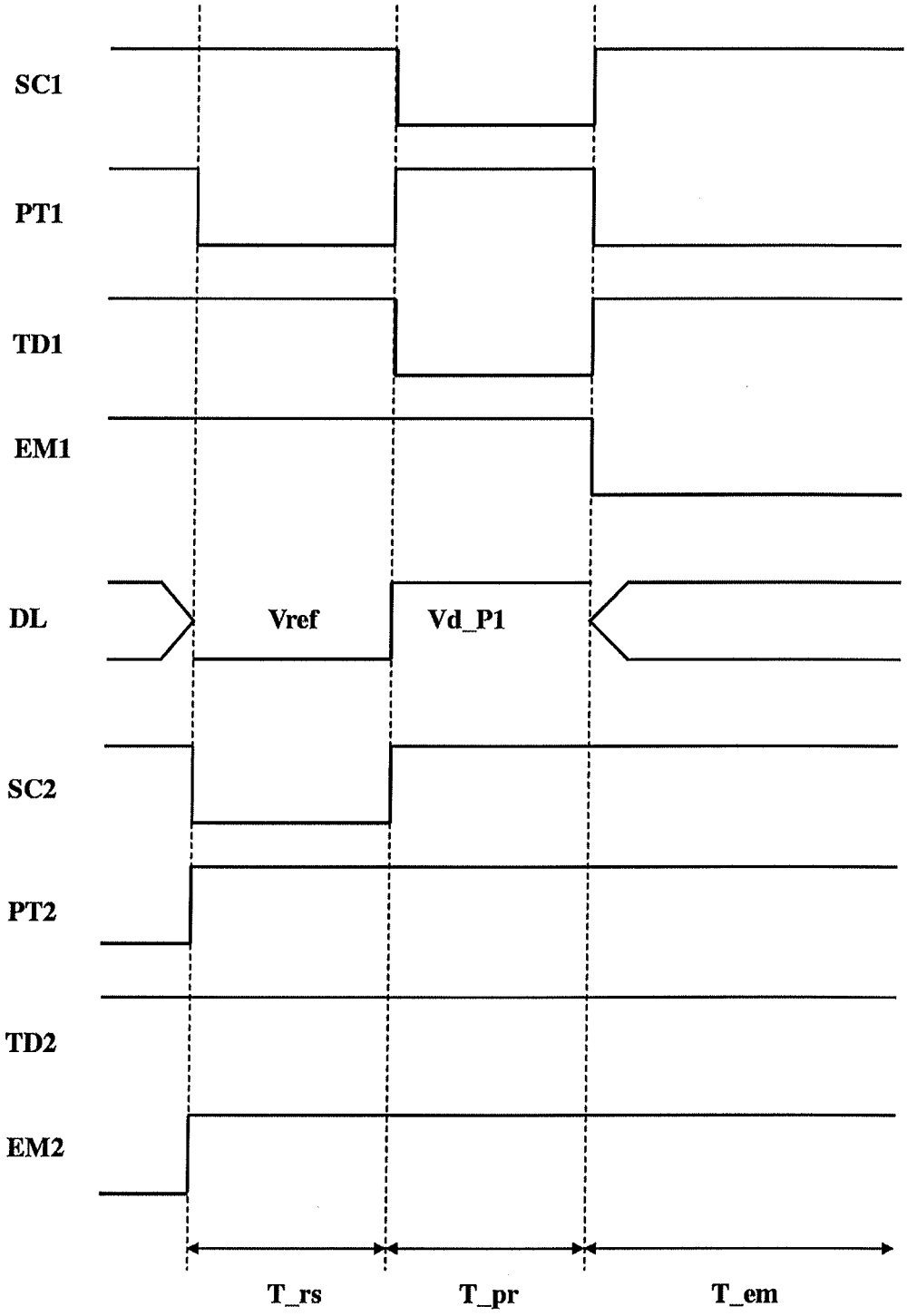
FIG. 3A is a waveform diagram illustrating waveforms of control signals applied to a first pixel and control signals applied to a second pixel during a first half frame period.
Figure 4A:
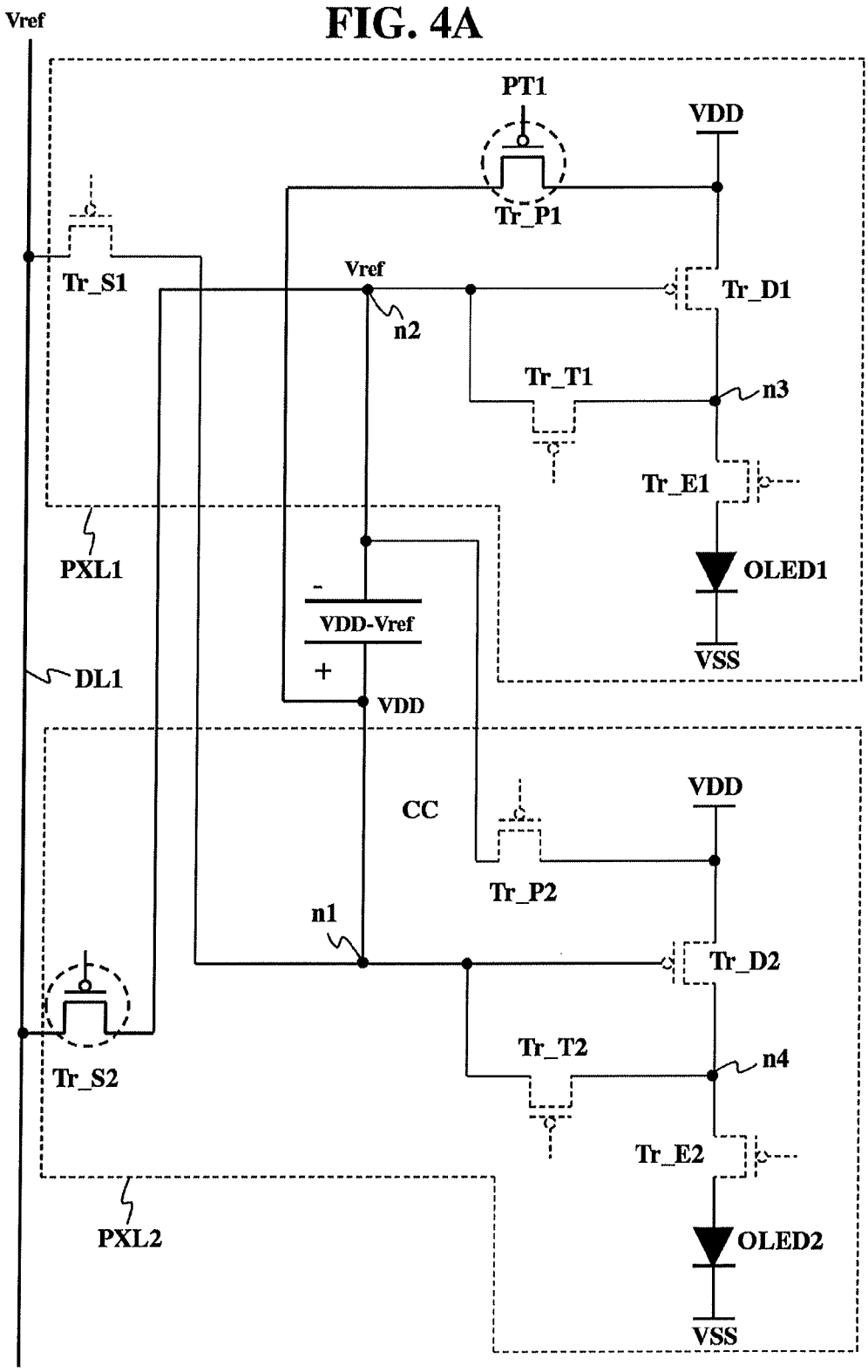
FIGS. 4A to 4C are circuit diagrams illustrating circuit states of the pixels of FIG. 2 in different times, respectively.
Figure 4B:
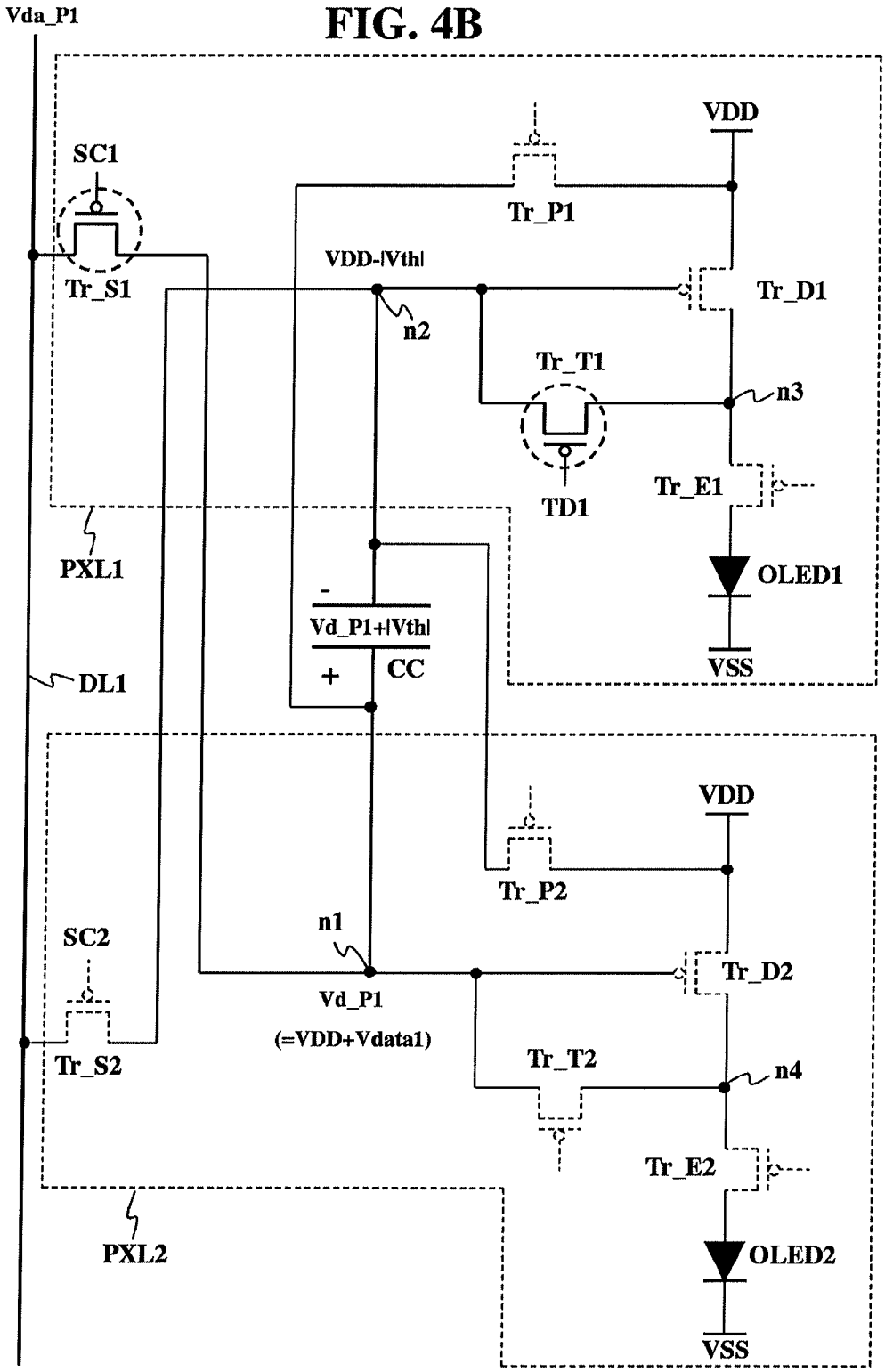
Figure 4C:
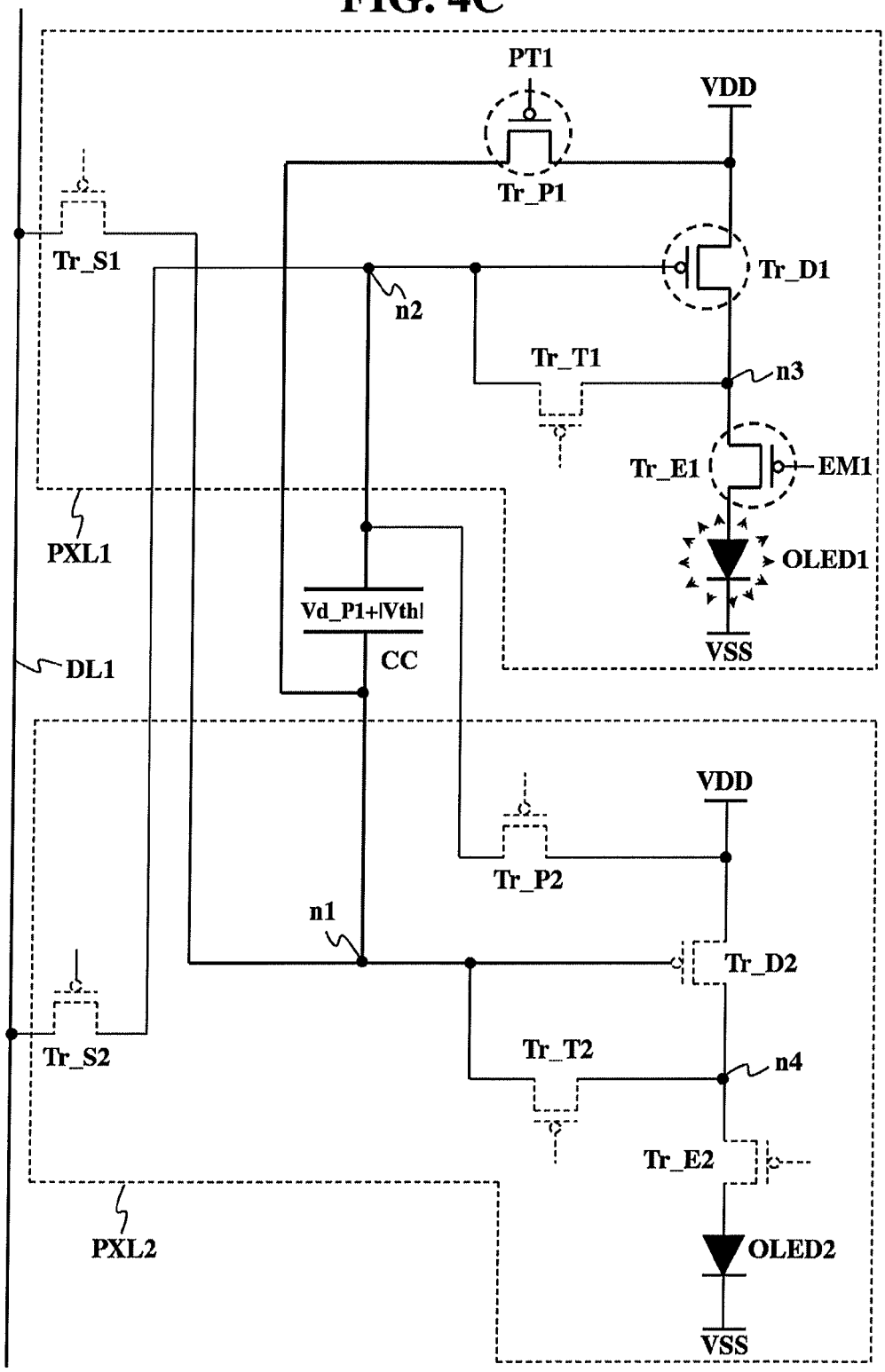

FIG. 3A is a waveform diagram illustrating waveforms of control signals applied to the first pixel PXL1 and control signals applied to the second pixel PXL2 during the first half frame period. FIGS. 4A to 4C are circuit diagrams illustrating circuit states of the pixels of FIG. 2 in different times, respectively.

The pixels included in the LED display device according to the present invention operate in accordance with a reset time T_rs, a programming time T_pr, and an emission time T_em, which are sequentially generated. Accordingly, the scan signals, voltage transfer control signals, threshold voltage detection signals, and emission control signals are changed between an active state and an inactive state, based on the sequentially generated reset time T_rs, programming time T_pr, and emission time T_em. Here, the active state of any one of the above-described signals means a state capable of turning on the switching element receiving the signal, and the inactive state of any one of the above-described signals means a state capable of turning off the switching element receiving the signal. In accordance with the present invention, N or P type transistors may be employed for the above-described first scan switching element Tr_S1, first voltage transfer switching element Tr_P1, first detection switching element Tr_T1, first driving switching element Tr_D1, first emission control switching element Tr_E1, second scan switching element Tr_S2, second voltage transfer switching element Tr_P2, second detection switching element Tr_T2, second driving switching element Tr_D2, and second emission control switching element Tr_E2. When all the above-described switching elements are of an N type, the active state means a high voltage state, and the inactive state means a low voltage state. On the other hand, all the above-described switching elements are of a P type, the active state means a low voltage state, and the inactive state means a high voltage state. The following description will be given in conjunction with an example in which each of the above-described switching elements is a P type transistor.

1) Reset Time in First Half Frame Period (T_rs)

First, operations of the first and second pixels PXL1 and PXL2 in the reset time T_rs of the first half frame period will be described with reference to FIGS. 3A and 4A.

During the reset time T_rs, as illustrated in FIG. 3A, the first scan signal SC1 is maintained in an inactive state, the first voltage transfer control signal PT1 is maintained in an active state, the first threshold voltage detection signal TD1 is maintained in an inactive state, and the first emission control signal EM1 is maintained in an inactive state. In addition, during the reset time T_rs, the second scan signal SC2 is maintained in an active state, the second voltage transfer control signal PT2 is maintained in an inactive state, the second threshold voltage detection signal TD2 is maintained in an inactive state, and the second emission control signal EM2 is maintained in an inactive state. Meanwhile, a reference voltage Vref is applied to the data line DL during the reset time T_rs.

In accordance with the above-described signals, as illustrated in FIG. 4A, the second scan switching element Tr_S2 and first voltage transfer switching element Tr_P1 are turned on, whereas the remaining switching elements are turned off. In FIGS. 4A to 4C, the turned-on switching elements are emphasized by dotted circles, and the turned-off switching elements are indicated by dotted lines.

As a result, the reference voltage Vref from the data line DL is applied to the second node n2 via the turned-on second scan switching element Tr_S2. In addition, the first drive voltage VDD from the first drive voltage line 333 is applied to the first node n1 via the turned-on first voltage transfer switching element Tr_P1. Accordingly, the reference voltage Vref and first drive voltage VDD are applied to both ends of the common capacitor CC, respectively, and, as such, the common capacitor CC is initialized. In this case, the common capacitor CC stores a voltage corresponding to a voltage difference between the first drive voltage VDD and the reference voltage Vref, namely, "VDD−Vref". A voltage corresponding to a sum of a data voltage and a threshold voltage corresponding to the second pixel PXL2 was stored in the common capacitor CC before the reset time T_rs. In the reset time T_rs, voltage initialization is executed in the above-described manner.

2) Programming Time in First Half Frame Period (T_pr)

Next, operations of the first and second pixels PXL1 and PXL2 in the programming time T_pr of the first half frame period will be described with reference to FIGS. 3A and 4B.

During the programming time T_pr, as illustrated in FIG. 3A, the first scan signal SC1 is maintained in an active state, the first voltage transfer control signal PT1 is maintained in an inactive state, the first threshold voltage detection signal TD1 is maintained in an active state, and the first emission control signal EM1 is maintained in an inactive state. In addition, during the programming time T_pr, the second scan signal SC2 is maintained in an inactive state, the second voltage transfer control signal PT2 is maintained in an inactive state, the second threshold voltage detection signal TD2 is maintained in an inactive state, and the second emission control signal EM2 is maintained in an inactive state. Meanwhile, a first data signal Vd_P1 associated with the first pixel PXL1 is applied to the data line DL during the programming time T_pr. The first data signal Vd_P1 is a voltage obtained by adding the first drive voltage VDD to a first data voltage Vdata1.

In accordance with the above-described signals, as illustrated in FIG. 4B, the first scan switching element Tr_S1 and first detection switching element Tr_T1 are turned on, whereas the remaining switching elements are turned off. In this case, the first driving switching element Tr_D1 is temporarily maintained in an ON state, and is then turned off.

That is, the first driving switching element Tr_D1 is maintained in an ON state just before the voltage between the gate and source of the first driving switching element Tr_D1 (hereinafter, referred to as a "gate-source voltage") reaches a threshold voltage Vth of the first driving switching element Tr_D1. In other words, when the voltage at the first node n1 increases in accordance with application of the first data signal Vd_P1 to the first node n1 by the turned-on first scan switching element Tr_S1, the voltage at the second node n2 is also increased by the common capacitor CC such that the voltage increase at the second node n2 corresponds to that of the first node n1. That is, the voltage at the second node n2 is increased to a voltage corresponding to a sum of the reference voltage Vref and the first data voltage Vdata1. As a result, the first driving switching element Tr_D1 is turned on and, as such, the first drive voltage VDD may be applied to the second node n2 via the turned-on first driving switching element Tr_D1 and first detection switching element Tr_T1. Then, the voltage at the second node n2 increases. When the voltage at the second node n2 reaches a voltage corresponding to a difference between the first drive voltage VDD and the threshold voltage (the threshold voltage Vth of the first driving switching element Tr_D1), the first driving switching element Tr_D1 is turned off. At this time, a voltage corresponding to a sum of the data signal Vd_P1 and the threshold voltage (the threshold voltage Vth of the first driving switching element Tr_D1) is stored in the common capacitor CC.

Thus, in the programming time T_pr, the threshold voltage Vth of the first driving switching element Tr_D1 is detected, and is then stored in the common capacitor CC.

3) Emission Time in First Half Frame Period (T_em)

Next, operations of the first and second pixels PXL1 and PXL2 in the emission time T_em of the first half frame period will be described with reference to FIGS. 3A and 4C.

During the emission time T_em, as illustrated in FIG. 3A, the first scan signal SC1 is maintained in an inactive state, the first voltage transfer control signal PT1 is maintained in an active state, the first threshold voltage detection signal TD1 is maintained in an inactive state, and the first emission control signal EM1 is maintained in an active state. In addition, during the emission time T_em, the second scan signal SC2 is maintained in an inactive state, the second voltage transfer control signal PT2 is maintained in an inactive state, the second threshold voltage detection signal TD2 is maintained in an inactive state, and the second emission control signal EM2 is maintained in an inactive state. Meanwhile, the reference voltage and data signal, which are required for the first pixel PXL1 of the next horizontal line, may be applied to the data line DL during the emission time T_em.

In accordance with the above-described signals, as illustrated in FIG. 4C, the first voltage transfer switching element Tr_P1, first emission control switching element Tr_E1, and first driving switching element Tr_D1 are turned on, whereas the remaining switching elements are turned off.

The turned-on first driving switching element Tr_D1 generates drive current having an amount corresponding to the voltage stored in the common capacitor CC, namely, Vd_P1+|Vth|, and supplies the drive current to the first LED OLED1 via the turned-on first emission control switching element Tr_E1. As a result, the first LED OLED1 emits light having an intensity according to the amount of the drive current.

Thus, in the first half frame period, previous information (the data voltage and threshold voltage of the second pixel PXL2) stored in the common capacitor CC is deleted, and the first data voltage Vdata1 and threshold voltage Vth of the first pixel PXL1 are newly stored.

Meanwhile, in the second half of the next frame period, the first data voltage Vdata1 and threshold voltage Vth of the first pixel PXL1 are deleted, and the data voltage and threshold voltage of the second pixel PXL2 are again stored. Thus, the control signals applied to the first pixel PXL1 and the control signals applied to the second pixel PXL2 in the second half frame period have states reversed from those in the first half frame period, respectively.

Figure 3B:
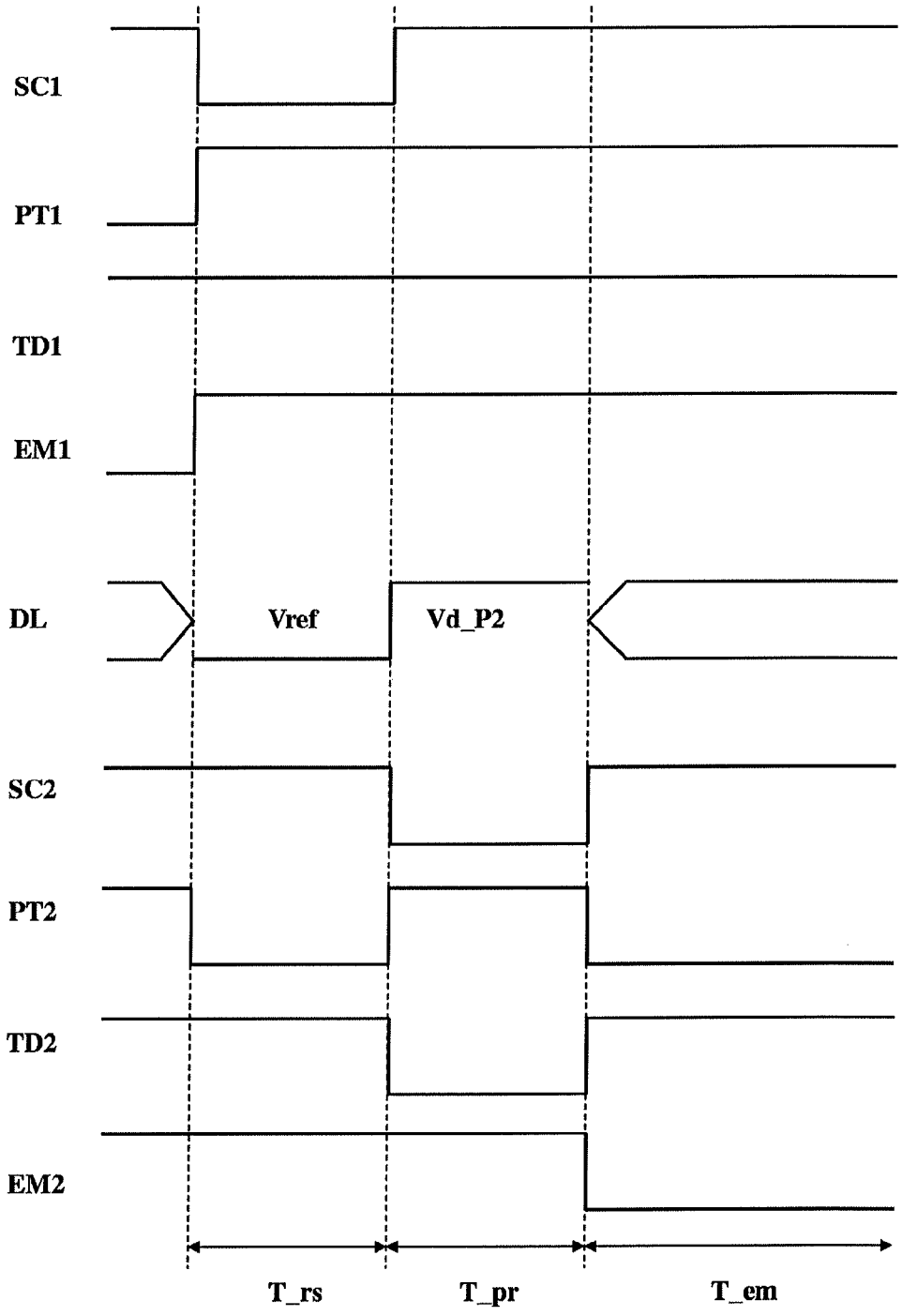
FIG. 3B is a waveform diagram illustrating waveforms of control signals applied to the first pixel and control signals applied to the second pixel during a second half frame period.

FIG. 3B is a waveform diagram illustrating waveforms of control signals applied to the first pixel PXL1 and control signals applied to the second pixel PXL2 during the second half frame period.

During the reset time T_rs in the second half frame period, as illustrated in FIG. 3B, the second scan signal SC2 is maintained in an inactive state, the second voltage transfer control signal PT2 is maintained in an active state, the second threshold voltage detection signal TD2 is maintained in an inactive state, and the second emission control signal EM2 is maintained in an inactive state. In addition, during the reset time T_rs in the second half frame period, the first scan signal SC1 is maintained in an active state, the first voltage transfer control signal PT1 is maintained in an inactive state, the first threshold voltage detection signal TD1 is maintained in an inactive state, and the first emission control signal EM1 is maintained in an inactive state. Meanwhile, during the reset time T_rs in the second half frame period, the reference voltage Vref is applied to the data line DL.

During the programming time T_pr in the second half frame period, as illustrated in FIG. 3B, the second scan signal SC2 is maintained in an active state, the second voltage transfer control signal PT2 is maintained in an inactive state, the second threshold voltage detection signal TD2 is maintained in an active state, and the second emission control signal EM2 is maintained in an inactive state. In addition, during the programming time T_pr in the second half frame period, the first scan signal SC1 is maintained in an inactive state, the first voltage transfer control signal PT1 is maintained in an inactive state, the first threshold voltage detection signal TD1 is maintained in an inactive state, and the first emission control signal EM1 is maintained in an inactive state. Meanwhile, during the programming time T_pr in the second half frame period, a second data signal Vd_P2 associated with the second pixel PXL2 is applied to the data line DL.

During the emission time T_em in the second half frame period, as illustrated in FIG. 3B, the second scan signal SC2 is maintained in an inactive state, the second voltage transfer control signal PT2 is maintained in an active state, the second threshold voltage detection signal TD2 is maintained in an inactive state, and the second emission control signal EM2 is maintained in an active state. In addition, during the emission time T_em in the second half frame period, the first scan signal SC1 is maintained in an inactive state, the first voltage transfer control signal PT1 is maintained in an inactive state, the first threshold voltage detection signal TD1 is maintained in an inactive state, and the first emission control signal EM1 is maintained in an inactive state.

Thus, it can be seen that the first scan signal SC1, first voltage transfer control signal PT1, first threshold voltage detection signal TD1, and first emission control signal EM1 applied to the first pixel PXL1 in the second half frame period are changed to have the same states as the second scan signal SC2, second voltage transfer control signal PT2, second threshold voltage detection signal TD2, and second emission control signal EM2 described with reference to FIG. 3A, respectively. On the other hand, the second scan signal SC2, second voltage transfer control signal PT2, second threshold voltage detection signal TD2, and second emission control signal EM2 applied to the second pixel PXL2 in the second half frame period are changed to have the same states as the first scan signal SC1, first voltage transfer control signal PT1, first threshold voltage detection signal TD1, and first emission control signal EM1 described with reference to FIG. 3A, respectively.

Figure 5A:
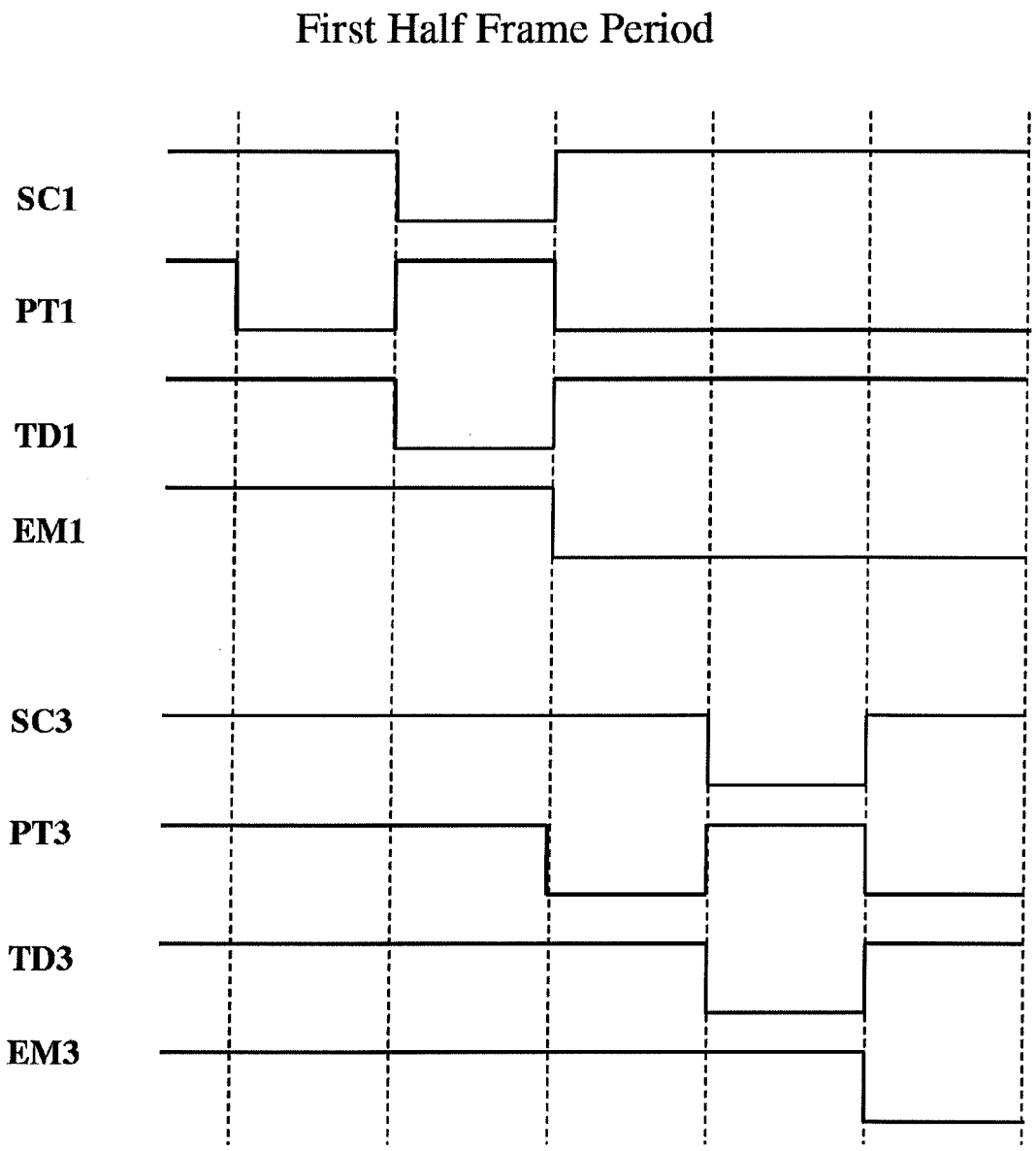
FIGS. 5A and 5B are waveform diagrams explaining timing of control signals supplied to two pixels connected to the same data line while being arranged on different odd-numbered horizontal lines, respectively.
Figure 5B:
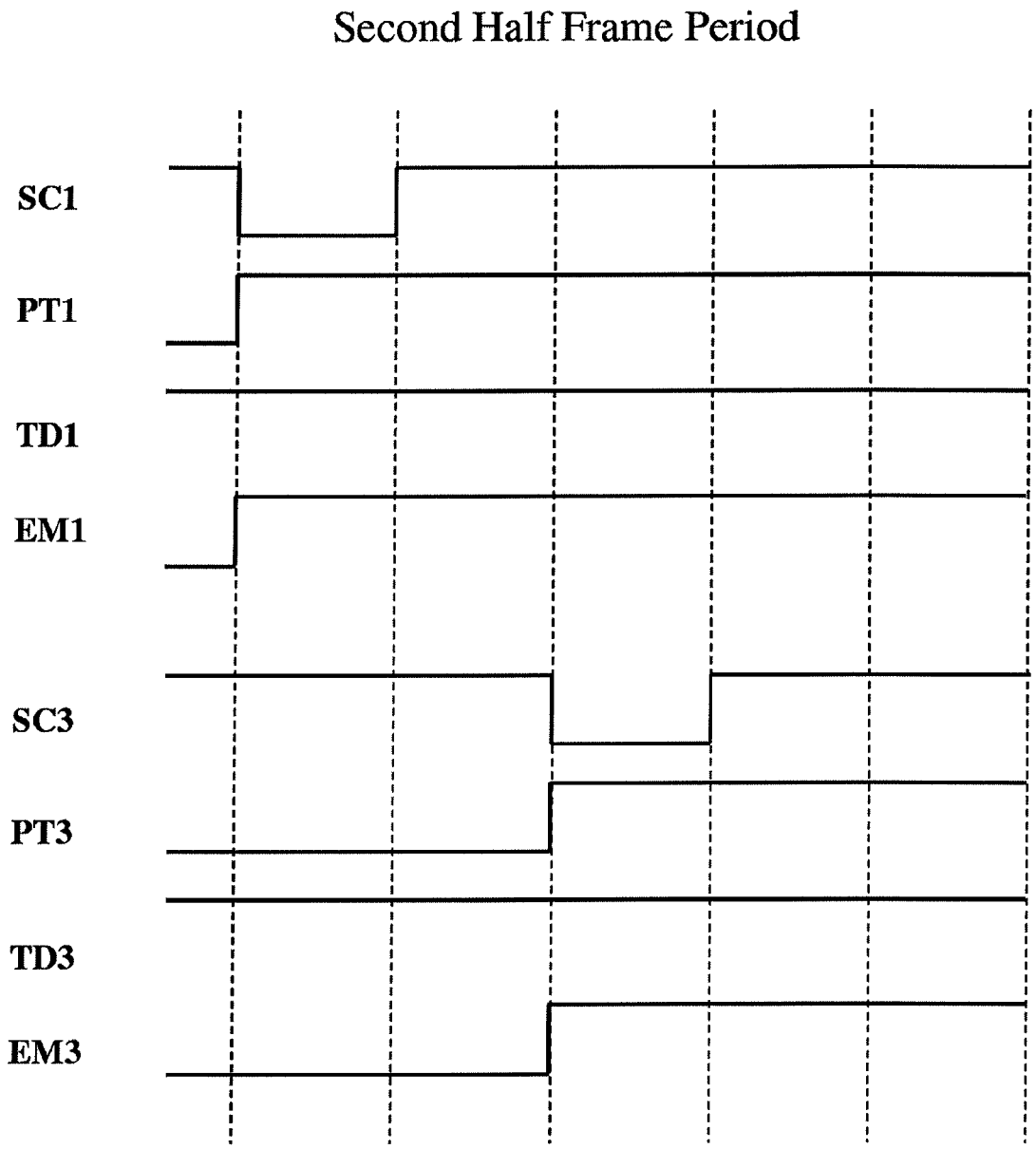

FIGS. 5A and 5B are waveform diagrams explaining timing of control signals supplied to two pixels connected to the same data line DL while being arranged on different odd-numbered horizontal lines, respectively.

As described above, the same name ones of i/2 scan signals, i/2 voltage transfer control signals, i/2 threshold voltage detection signals, and i/2 emission control signals supplied to the odd-numbered horizontal lines in the first half frame period are temporally different in terms of output timing while having the same waveform. For example, the first scan signal SC1 supplied to the first horizontal line HL1 and the third scan signal SC3 supplied to the third horizontal line HL3 in the first half frame period have the same waveform, as illustrated in FIG. 5A. Of course, the third scan signal SC3 is output after being delayed for a predetermined time, as compared to the first scan signal SC1. The remaining third voltage transfer control signal PT3, third threshold voltage detection signal TD3, and third emission control signal EM3 also have the same waveforms as the first voltage transfer control signal PT1, first threshold voltage detection signal TD1, and first emission control signal EM1, respectively, but have delayed output timing, as compared to the latter signals.

Similarly, the same name ones of i/2 scan signals, i/2 voltage transfer control signals, i/2 threshold voltage detection signals, and i/2 emission control signals supplied to the odd-numbered horizontal lines in the second half frame period are temporally different in terms of output timing while having the same waveform. For example, the first scan signal SC1 supplied to the first horizontal line HL1 and the third scan signal SC3 supplied to the third horizontal line HL3 in the second half frame period have the same waveform, as illustrated in FIG. 5B. Of course, the third scan signal SC3 is output after being delayed for a predetermined time, as compared to the first scan signal SC1. The remaining third voltage transfer control signal PT3, third threshold voltage detection signal TD3, and third emission control signal EM3 also have the same waveforms as the first voltage transfer control signal PT1, first threshold voltage detection signal TD1, and first emission control signal EM1, respectively, but have delayed output timing, as compared to the latter signals.

Although not shown, corresponding control signals supplied to pixels connected to the same data line DL while being arranged on different even-numbered horizontal lines are identical, only except that they are different in terms of output timing as shown in FIGS. 5A and 5B.

Figure 6:
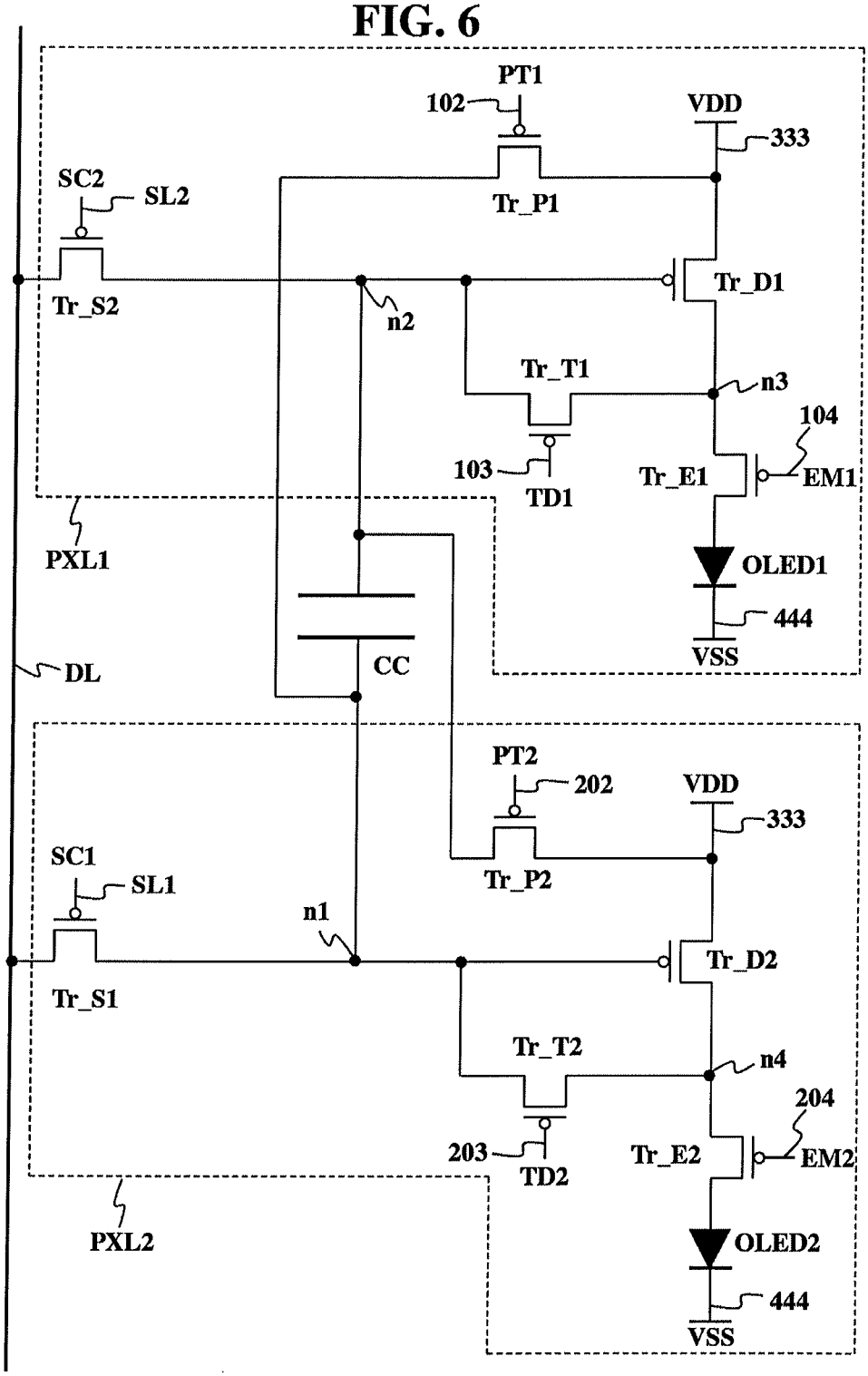
FIG. 6 is a circuit diagram illustrating a circuit configuration of pixels according to another embodiment of the present invention.

FIG. 6 is a circuit diagram illustrating a circuit configuration of pixels according to another embodiment of the present invention.

Elements illustrated in FIG. 6, namely, a first scan switching element Tr_S1, a first voltage transfer switching element Tr_P1, a first detection switching element Tr_T1, a first driving switching element Tr_D1, a first emission control switching element Tr_E1, a first LED OLED1, a second scan switching element Tr_S2, a second voltage transfer switching element Tr_P2, a second detection switching element Tr_T2, a second driving switching element Tr_D2, a second emission control switching element Tr_E2, a second LED OLED2, and a common capacitor CC, are identical to those of the above-described previous embodiment. However, the first scan switching element Tr_S1 and second scan switching element Tr_S2 have positions opposite to those of the previous embodiment. That is, the second scan switching element Tr_S2 is disposed at a higher position than that of the first scan switching element Tr_S1. It is possible to reduce the number of intersections of lines connecting the elements through change of the positions of the first and second scan switching elements Tr_S1 and Tr_S2.

As apparent from the above description, in accordance with the present invention, it is possible to reduce pixel size because only one common capacitor is required per two pixels. Accordingly, advantages may be provided when a display panel having high resolution and high definition is manufactured, using the pixel structure of the present invention.

Figure 7:
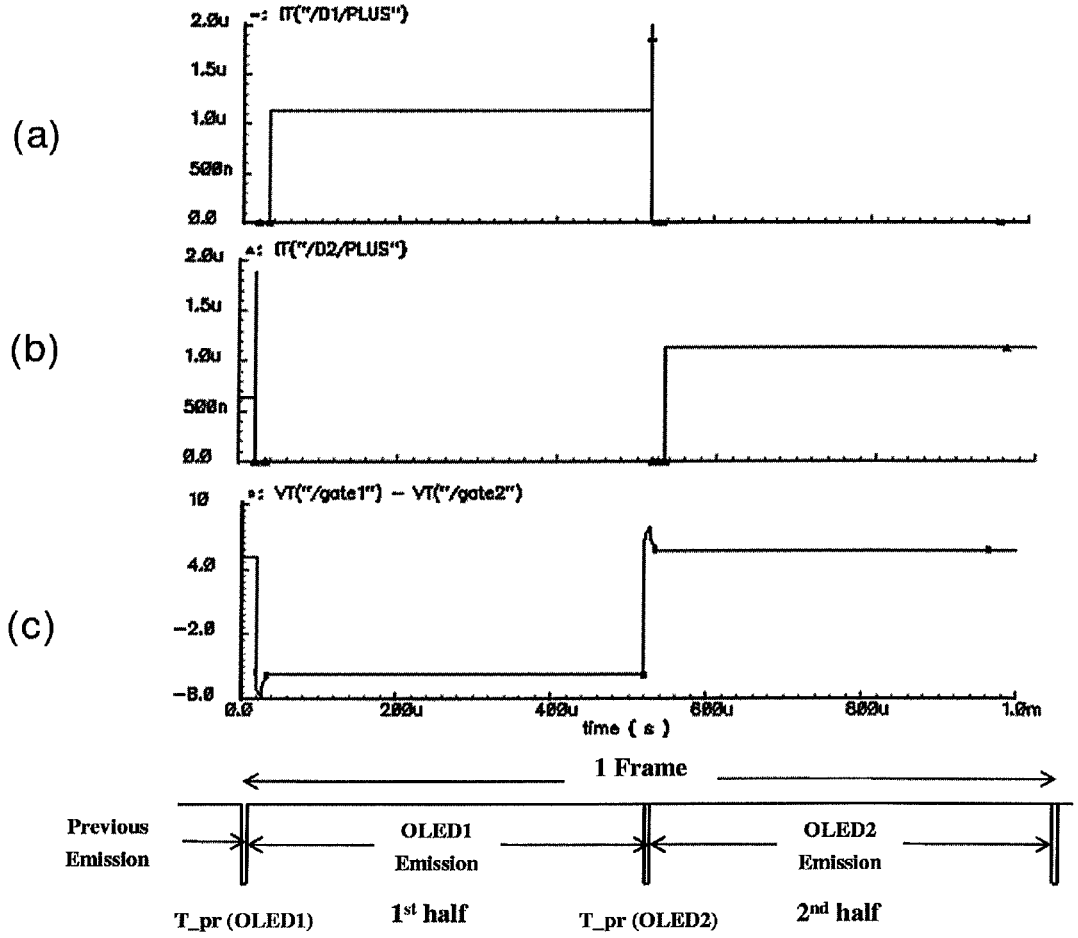
FIG. 7 is a diagram illustrating respective current amounts flowing through each LED and respective voltages across each common capacitor in the first half frame period and second half frame period.

FIG. 7 is a diagram illustrating respective current amounts flowing through each LED and respective voltages across each common capacitor in the first half frame period and second half frame period.

FIG. 7(*a*) depicts current amounts respectively flowing through the first and second LEDs OLED1 and OLED2 in the first half frame period. Referring to FIG. 7(*a*), it can be seen that specific drive current flows through the first LED OLED1, whereas no drive current is supplied to the second LED OLED2.

FIG. 7(*b*) depicts current amounts respectively flowing through the first and second LEDs OLED1 and OLED2 in the second half frame period. Referring to FIG. 7(*b*), it can be seen that specific drive current flows through the second LED OLED2, whereas no drive current is supplied to the first LED OLED2.

FIG. 7(*c*) depicts a voltage across the common capacitor CC and a voltage difference between the voltage at the second node n2 and the voltage at the first node n1. In the first half frame period, the voltage at the second node n2 is lower than the voltage at the first node n1 and, as such, the voltage across the common capacitor CC is negative. On the other hand, in the second half frame period, the voltage at the second node n2 is higher than the voltage at the first node n1 and, as such, the voltage across the common capacitor CC is positive.

Figure 8:
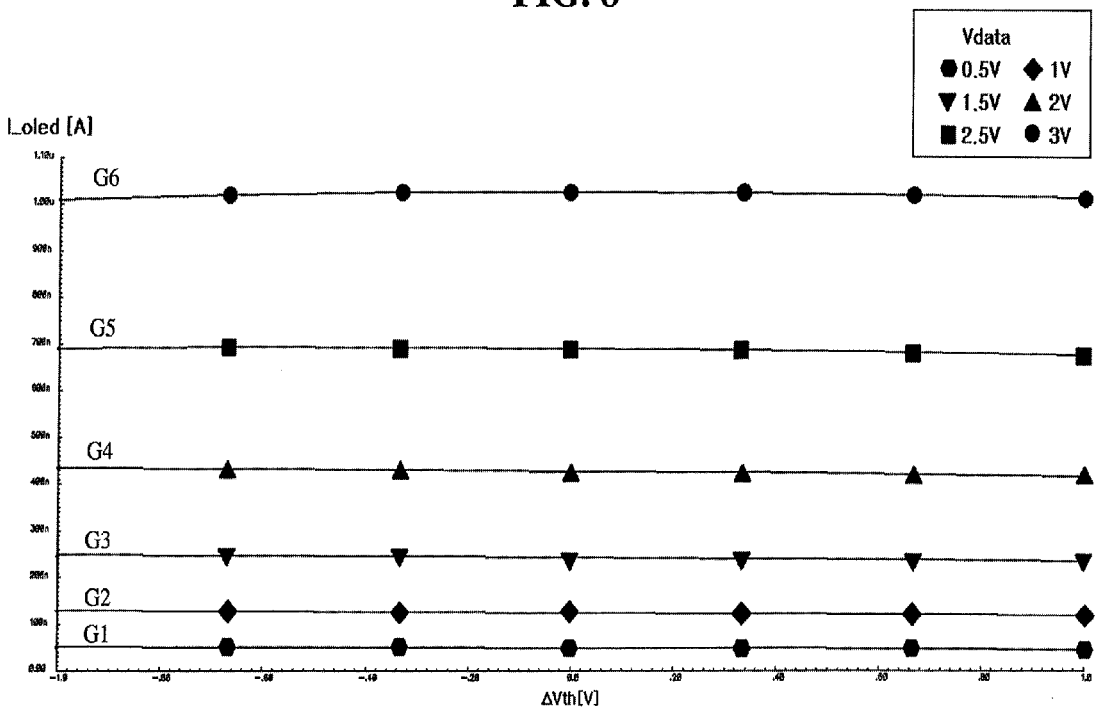
FIG. 8 illustrates graphs each depicting a variation in drive current according to a variation in threshold voltage of a corresponding one of driving switching elements.

FIG. 8 illustrates graphs each depicting a variation in drive current according to a variation in threshold voltage of a corresponding one of the driving switching elements.

The first graph G1 depicts a value of drive current I_oled flowing through an LED when the threshold voltage of the driving switching element is varied under the condition that the data voltage Vdata is fixed to 0.5V. Referring to the first graph G1, it can be seen that the value of the drive current I_oled versus the threshold voltage is almost constant without being varied.

The second graph G2 depicts a value of drive current I_oled flowing through the LED when the threshold voltage of the driving switching element is varied under the condition that the data voltage Vdata is fixed to 1V. Referring to the second graph G2, it can be seen that the value of the drive current I_oled versus the threshold voltage is almost constant without being varied.

The third graph G3 depicts a value of drive current I_oled flowing through the LED when the threshold voltage of the driving switching element is varied under the condition that the data voltage Vdata is fixed to 1.5V. Referring to the third graph G3, it can be seen that the value of the drive current I_oled versus the threshold voltage is almost constant without being varied.

The fourth graph G4 depicts a value of drive current I_oled flowing through the LED when the threshold voltage of the driving switching element is varied under the condition that the data voltage Vdata is fixed to 2V. Referring to the fourth graph G4, it can be seen that the value of the drive current I_oled versus the threshold voltage is almost constant without being varied.

The fifth graph G5 depicts a value of drive current I_oled flowing through the LED when the threshold voltage of the driving switching element is varied under the condition that the data voltage Vdata is fixed to 2.5V. Referring to the fifth graph G5, it can be seen that the value of the drive current I_oled versus the threshold voltage is almost constant without being varied.

The sixth graph G6 depicts a value of drive current I_oled flowing through the LED when the threshold voltage of the driving switching element is varied under the condition that the data voltage Vdata is fixed to 3V. Referring to the sixth graph G6, it can be seen that the value of the drive current I_oled versus the threshold voltage is almost constant without being varied.

Figure 9:
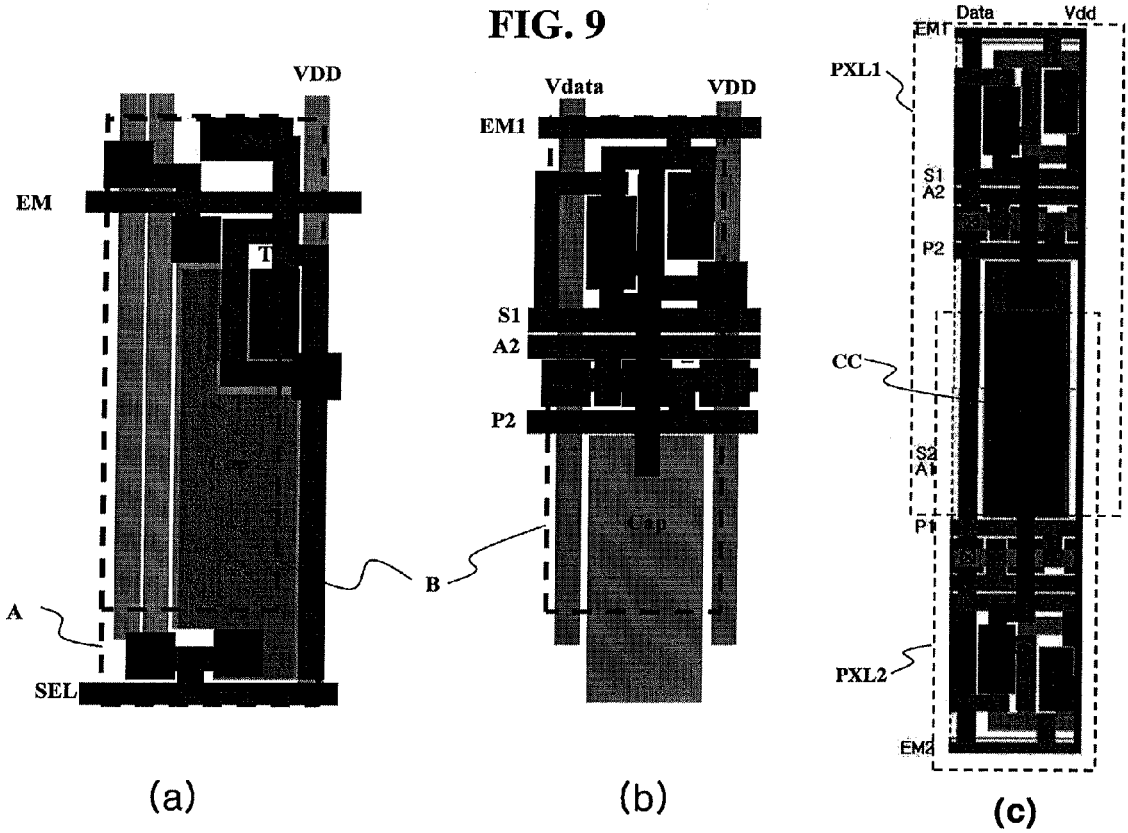
FIG. 9 is a view explaining effects of the present invention.

FIG. 9 is a view explaining effects of the present invention.

FIG. 9(*a*) illustrates a conventional pixel structure. FIG. 9(*b*) illustrates a pixel structure according to the present invention. FIG. 9(*c*) illustrates four pixel structures according to the present invention.

As illustrated in FIG. 9(*a*), the conventional pixel occupies an area corresponding to a region A. However, the pixel of the present invention occupies an area corresponding to a region B more or less smaller than the region A, as illustrated in FIG. 9(*b*).

Referring to FIG. 9(*c*), two pixels, namely, a first pixel PXL1 and a second pixel PXL2, share one common capacitor CC.

As apparent from the above description, in accordance with the present invention, it is possible to reduce pixel size because only one common capacitor is required per two pixels. Accordingly, advantages may be provided when a display panel having high resolution and high definition is manufactured, using the pixel structure of the present invention.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A light emitting diode display device comprising:

a first scan switching element connected between a data line and a first node and being controlled in accordance with a first scan signal;

a first voltage transfer switching element connected between a first drive voltage line to transmit a first drive voltage and the first node and being controlled in accordance with a first voltage transfer control signal;

a first detection switching element connected between a second node and a third node and being controlled in accordance with a first threshold voltage detection signal;

a first driving switching element connected between the first drive voltage line and the third node and being controlled in accordance with a signal applied to the second node;

a first emission control switching element connected between the third node and a first light emitting diode and being controlled in accordance with a first emission control signal;

a second scan switching element connected between the data line and the second node and being controlled in accordance with a second scan signal;

a second voltage transfer switching element connected between the first drive voltage line and the second node and being controlled in accordance with a second voltage transfer control signal;

a second detection switching element connected between the first node and a fourth node and being controlled in accordance with a second threshold voltage detection signal;

a second driving switching element connected between the first drive voltage line and the fourth node and being controlled in accordance with a signal applied to the first node;

a second emission control switching element between the fourth node and a second light emitting diode and being controlled in accordance with a second emission control signal; and a common capacitor connected between the first node and the second node.

2. The light emitting diode display device according to claim 1, wherein:

the first scan switching element, the first voltage transfer switching element, the first detection switching element, the first driving switching element, and the first light emitting diode are included in a first pixel;

the second scan switching element, the second voltage transfer switching element, the second detection switching element, the second driving switching element, and the second light emitting diode are included in a second pixel; and the first pixel and the second pixel share the common capacitor.

3. The light emitting diode display device according to claim 2, wherein the first pixel and the second pixel alternately use the common capacitor.

4. The light emitting diode display device according to claim 2, wherein:

the first pixel turns on the first light emitting diode in a first half of one frame period, and the second pixel turns on the second light emitting diode in a second half of the frame period; and one of the first and second light emitting diodes is turned off when the other of the first and second light emitting diodes is turned on.

5. The light emitting diode display device according to claim 4, wherein:

each of the first and second pixels operates in an order of a reset time, a programming time, and an emission time;

during the reset time in the first half frame period, the first scan signal is maintained in an inactive state, the first voltage transfer control signal is maintained in an active state, the first threshold voltage detection signal is maintained in an inactive state, the first emission control signal is maintained in an inactive state, the second scan signal is maintained in an active state, the second voltage transfer control signal is maintained in an inactive state, the second threshold voltage detection signal is maintained in an inactive state, the second emission control signal is maintained in an inactive state, and a reference voltage is applied to the data line;

during the programming time in the first half frame period, the first scan signal is maintained in an active state, the first voltage transfer control signal is maintained in an inactive state, the first threshold voltage detection signal is maintained in an active state, the first emission control signal is maintained in an inactive state, the second scan signal is maintained in an inactive state, the second voltage transfer control signal is maintained in an inactive state, the second threshold voltage detection signal is maintained in an inactive state, the second emission control signal is maintained in an inactive state, and a first data signal associated with the first pixel is applied to the data line; and during the emission time in the first half frame period, the first scan signal is maintained in an inactive state, the first voltage transfer control signal is maintained in an active state, the first threshold voltage detection signal is maintained in an inactive state, the first emission control signal is maintained in an active state, the second scan signal is maintained in an inactive state, the second voltage transfer control signal is maintained in an inactive state, the second threshold voltage detection signal is maintained in an inactive state, and the second emission control signal is maintained in an inactive state.

6. The light emitting diode display device according to claim 5, wherein:

during the reset time in the second half frame period, the second scan signal is maintained in an inactive state, the second voltage transfer control signal is maintained in an active state, the second threshold voltage detection signal is maintained in an inactive state, the second emission control signal is maintained in an inactive state, the first scan signal is maintained in an active state, the first voltage transfer control signal is maintained in an inactive state, the first threshold voltage detection signal is maintained in an inactive state, the first emission control signal is maintained in an inactive state, and the reference voltage is applied to the data line;

during the programming time in the second half frame period, the second scan signal is maintained in an active state, the second voltage transfer control signal is maintained in an inactive state, the second threshold voltage detection signal is maintained in an active state, the second emission control signal is maintained in an inactive state, the first scan signal is maintained in an inactive state, the first voltage transfer control signal is maintained in an inactive state, the first threshold voltage detection signal is maintained in an inactive state, the first emission control signal is maintained in an inactive state, and a second data signal associated with the second pixel is applied to the data line; and during the emission time in the second half frame period, the second scan signal is maintained in an inactive state, the second voltage transfer control signal is maintained in an active state, the second threshold voltage detection signal is maintained in an inactive state, the second emission control signal is maintained in an active state, the first scan signal is maintained in an inactive state, the first voltage transfer control signal is maintained in an inactive state, the first threshold voltage detection signal is maintained in an inactive state, and the first emission control signal is maintained in an inactive state.

* * * * *